United States Patent [19]

Credoz et al.

[11] 4,404,038

[45] Sep. 13, 1983

[54] PROCESS AND INSTALLATION FOR PRODUCING LACTOSE CRYSTALS

[75] Inventors: Paul Credoz, Hellemmes Lille; Pierre Beuneu, Roubaix, both of France

[73] Assignee: Fives-Cail Babcock, Paris, France

[21] Appl. No.: 319,909

[22] Filed: Nov. 10, 1981

[30] Foreign Application Priority Data

Nov. 10, 1980 [FR] France ..... 80 23958

[51] Int. Cl.[3] ..... C13F 1/02; C13F 1/06; C13K 5/00

[52] U.S. Cl. ..... 127/60; 23/301; 127/31; 127/58; 127/61; 127/62; 127/16

[58] Field of Search ..... 127/31, 58, 60, 16, 127/61, 15, 62; 23/301; 159/45; 426/491, 492

[56] References Cited

U.S. PATENT DOCUMENTS

| | | | |
|---|---|---|---|
| 1,715,049 | 5/1929 | Varnau et al. | 127/60 X |
| 2,555,212 | 5/1951 | Wallace | 127/31 |
| 2,569,357 | 9/1951 | Vahl | 23/301 X |
| 2,778,750 | 1/1957 | Hull | 127/31 |
| 3,709,731 | 1/1973 | Kingma | 127/16 X |
| 3,981,739 | 9/1976 | Dmitrovsky et al. | 127/60 |
| 4,099,983 | 7/1978 | Wittenberg | 127/31 X |
| 4,339,280 | 7/1982 | Mercier | 127/60 X |

FOREIGN PATENT DOCUMENTS

| | | | |
|---|---|---|---|
| 2014527 | 10/1971 | Fed. Rep. of Germany | 127/60 |
| 2209243 | 9/1972 | Fed. Rep. of Germany | 127/60 |

*Primary Examiner*—Kenneth M. Schor
*Attorney, Agent, or Firm*—Kurt Kelman

[57] ABSTRACT

To increase the percentage of crystallized lactose obtained from lactoserum substantially without noticeably increasing investment costs or energy consumption, the first phase of crystallization is effectuated in a continuous crystallization stage wherein seeds of crystallization are added to the lactoserum to initiate crystallization, the lactoserum is concentrated, the concentrated lactoserum is brought to a supersaturated state and maintained at this stage by evaporation to obtain a mixture of mother liquor and lactose crystals, which is subjected to two centrifugal drying stages to obtain a first portion of large lactose crystals and a second portion of such crystals grown by cooling.

10 Claims, 2 Drawing Figures

PROCESS AND INSTALLATION FOR PRODUCING LACTOSE CRYSTALS

Figure 1:
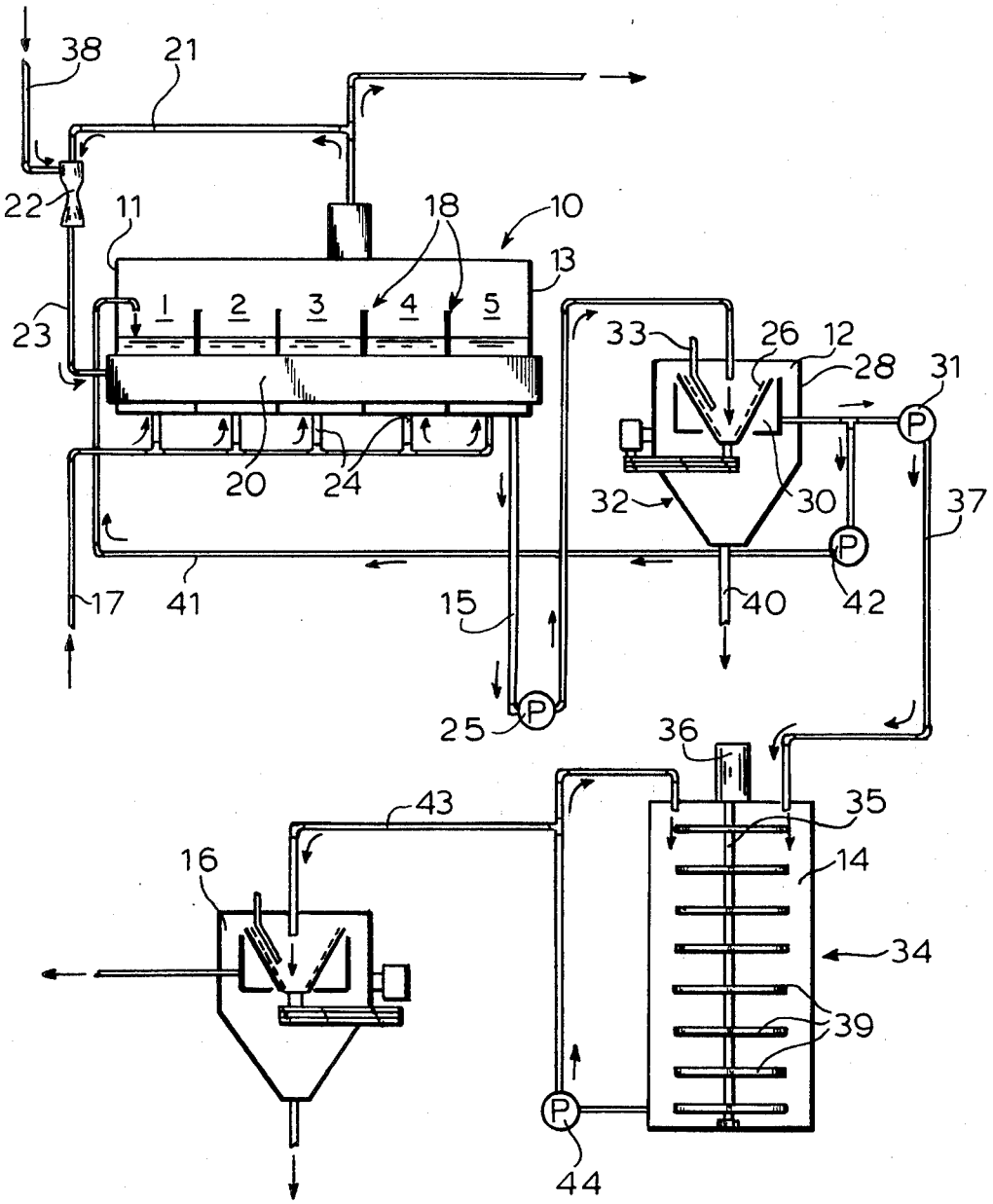

The present invention relates to the production of lactose crystals.

Crystallized lactose is produced in three commercial forms: (1) crude or technical lactose having a purity of 92% to 98%; (2) edible lactose having a purity in excess of 98%; and (3) pharmaceutical lactose with a purity exceeding 99.85%.

Commercial lactose is obtained from whole lactoserum or from lactoserum which has been deproteinized and/or demineralized. The lactoserum is concentrated by evaporation and subjected to crystallization, and the resultant crystals are separated, crushed and, optionally, refined. Generally, the crystallization is effectuated by cooling the concentrated lactoserum and the percentage of crystallized lactose in relation to the total amount of lactose is very small. To improve the output of recovered lactose, it has been proposed to effectuate the crystallization in two stages, the concentrated lactose being first brought to the supersaturated state in a vacuum pan used in the sugar refining industry and being seeded with crystal seeds, and the contents of the vacuum pan then being transferred to a conventional crystallization apparatus where they are cooled to complete the crystallization. This process has the disadvantage of being a batch process taking a long time and being costly because it consumes considerable amounts of steam.

It is the object of this invention to increase the output of lactose substantially without noticeably increasing the costs of plant investment and of energy consumption.

The above and other objects are accomplished in accordance with one aspect of the invention with a process comprising the steps of effectuating a first phase of crystallization in a continuous crystallization stage wherein seeds of crystallization are added to the lactoserum to initiate crystallization, the lactoserum is concentrated, the concentrated lactoserum is brought to a supersaturated state and maintained at this state by evaporation to obtain a mixture of a mother liquor and lactose crystals. The mixture is removed from the first crystallization phase and subjected to a first centrifugal drying stage in a continuously operating drier having a screen separating the mother liquor from the lactose crystals whose dimensions exceed the range of 40 to 90 microns while crystals of dimensions below this range remain in the mother liquor. The mother liquor containing the latter crystals is cooled to cause the crystals in the mother liquor to grow, and the mother liquor with the grown crystals is subjected to a second centrifugal drying stage to separate the grown crystals from the mother liquor.

According to another aspect of the present invention, an installation for carrying out the above process comprises a crystallization apparatus which is constituted by a horizontal vat divided by transverse walls into a plurality of compartments extending from an inlet end to an outlet end of the vat. Each compartment comprises an inlet for the lactoserum and means for heating the compartment whereby the lactoserum is concentrated and maintained at a concentrated state as it successively flows through the compartments towards the outlet end to obtain a mixture of a mother liquor and lactose crystals.

Figure 2:
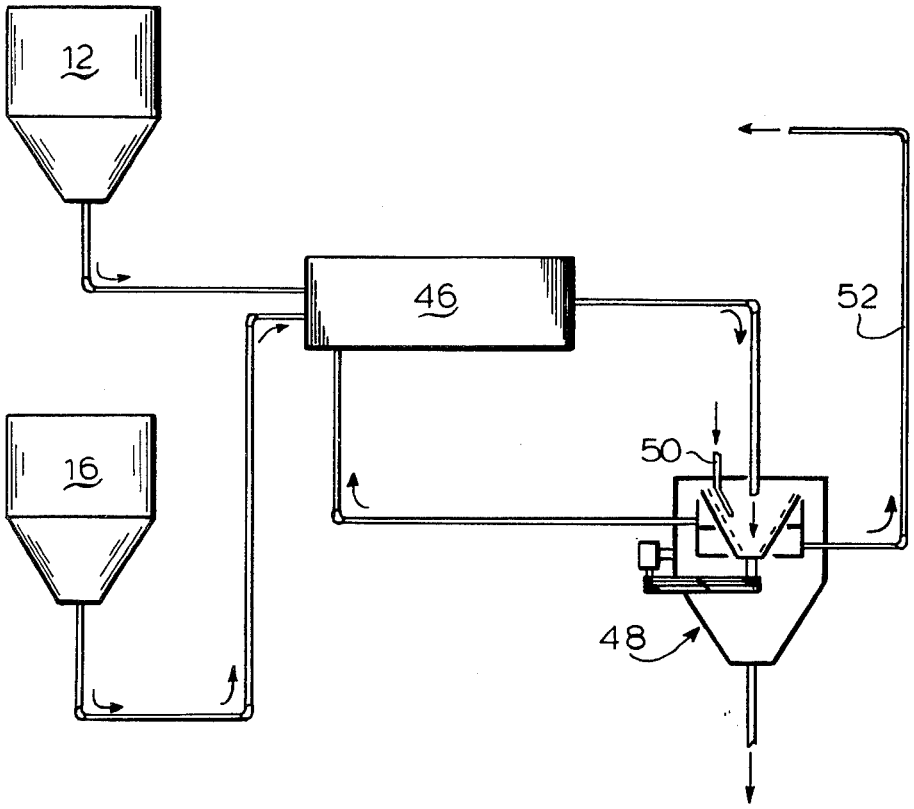

The above and other objects, advantages and features of the present invention will become more apparent from the following detailed description of certain now preferred embodiments of an installation constructed and operated according to this invention, taken in conjunction with the schematic drawing wherein FIG. 1 shows a flow diagram illustrating one embodiment of the installation and FIG. 2 is a still more diagrammatic view of another embodiment.

Referring now to the drawing and first to the installation for producing crystallized lactose from lactoserum, as illustrated in FIG. 1, there is shown crystallization apparatus 10 for the continuous crystallization of lactoserum by evaporation. The crystallization apparatus is constituted by a closed cylindrical vat divided by transverse walls 18 into a plurality of compartments 1 to 5 extending from inlet end 11 to outlet end 13 of the vat. Partitions 18 are lower than the height of the vat so that the vat compartments are in communication with each other at the upper part of the vat. The transverse partition walls define ports to permit passage of the product being treated in the vat from one compartment to the other whereby it successively flows through the compartments towards outlet end 13.

Crystallization apparatus 10 has means including conduit 41 for feeding seeds of crystallization to one of the compartments at inlet end 11 to initiate crystallization, the crystallization seeds being fed to compartment 1 in the illustrated embodiment. Furthermore, each compartment comprises inlet 24 for the lactoserum and means 20 for heating the compartment whereby the lactoserum is concentrated and maintained at a concentrated state by evaporation as it flows through the compartments towards the outlet end to obtain a mixture of a mother liquor and lactose crystals.

The heating means may be constituted by hollow elements, such as a radiator formed by horizontal tubes disposed parallel to the axis of the cylindrical vat and extending through the lower part of the vat to be permanently immersed in the product being treated and filling the lower part of the vat. Live steam is fed to thermo-compressor 22 through conduit 38 and the compressor has an inlet receiving vapor removed from the upper part of the vat through conduit 21. The live steam recompresses this vapor and an outlet of the compressor is connected by conduit 23 to the hollow elements of the heating means for feeding the compressed vapor thereto for heating the elements. If desired, a motor-driven compressor may be used.

In addition to crystallization apparatus 10, the installation comprises first centrifugal drier 12, cooling means 14 and second centrifugal drier 16. The crystallization apparatus, the cooling means and the centrifugal driers operate in a continuous manner, i.e. the produce is fed thereto and removed therefrom continuously.

The mixture of a mother liquor and lactose crystals is removed from an outlet of the vat through conduit 15 and pumped by pump 25 to first centrifugal drier 12 arranged to receive the mixture and having screen 26 to separate the mother liquor from crystals with dimensions exceeding 40 to 90 microns.

Centrifugal driers 12 and 16 are conventional and will, therefore, not be described in detail. They are of the type disclosed in French Pat. No. 79.06829, published under U.S. Pat. No. 2,451,778 on Oct. 17, 1980. Each drier comprises a frusto-conical screen 26 and a like basket holding the screen, the rotary basket and screen being mounted in housing 28. As shown, the basket is mounted on a vertical shaft extending along the axis of the basket and rotatable about the axis. The mixture of mother liquor and lactose crystals is fed axially into the interior of the basket and falls to the bottom of the rotating basket where it is subjected to centrifugal forces. The rotating screen separates the mother liquor from the lactose crystals whose dimensions exceed the range of 40 to 90 microns while crystals of dimensions below this range remain in the mother liquor, the mesh size of screen 26 being such as to obtain this crystal classification. The mother liquor containing the crystals of smaller size passes through screen 26 and the centrifugal forces drive it up the conical wall of the rotary basket and over the upper rim thereof into chamber 30 defined by a sleeve surrounding the basket and having an upper rim close to the upper rim of the basket and a bottom fixed to the sleeve opposite to the upper rim. The larger size crystals are driven by the centrifugal forces up the conical wall of screen 26 and are ejected at the upper rim of screen 26 into housing 28 where they fall into hopper 32 attached to the bottom of the housing. The large-size crystals are recovered from centrifugal drier 12 through outlet conduit 40. Means 33 for washing the large-size crystals are disposed inside the rotary basket of the drier to wash the crystals with water before they are ejected into housing 28, the washing means being comprised of rows of sprinklers, for example.

The mother liquor containing the small-size crystals is removed from chamber 30 through conduit 37 and fed to cooling means 14 by pump 31. The illustrated cooling means is also conventional and will, therefore, not be described in detail. It is of the type disclosed in French Pat. No. 79.18325, published under U.S. Pat. No. 2,461,754 on Feb. 6, 1981. It is a cooling mixer comprised of cylindrical vat 34 having a vertical axis. Rotary shaft 35 extends axially through vat 34 and carries mixing elements 39 which also serve as cooling elements. For example, mixing and cooling elements 39 may be constituted by tubular coils through which a cooling fluid circulates. Alternatively, rows of cooling tubes fixed to the wall of vat 34 may alternate with vanes fixed to rotary shaft 35 cooperating with the cooling tubes to mix the product in the vat while cooling it. A suitable motor means 36 is connected to shaft 35 to rotate the same.

Second centrifugal drier 16 is arranged to receive the cooled mother liquor which is fed thereto through conduit 43 by pump 44 to separate the mother liquor from the crystals which have grown in cooling means 14.

In operating the installation described hereinabove, lactoserum is first concentrated in an evaporator (not shown) and this pre-concentrated lactoserum is continuously introduced through main 17 feeding inlets 24 leading into compartments 1 to 5 of crystallization apparatus 10. In this first phase of crystallization, seeds of crystallization are added to the lactoserum to initiate crystallization in the vat of apparatus 10. In the illustrated embodiment, a portion of the mother liquor containing the small-size crystals is recirculated by pump 42 from a first drying stage constituted by centrifugal drier 12 to inlet 11 of the continuous crystallization stage and the crystals contained in the mother liquor are used as the seeds of crystallization. The amount of this recycled portion depends on the nature of the product treated in the crystallization stage and the quality of the desired crystals. If desired and alternatively, the seeds of crystallization added in apparatus 10 may be obtained by crushing lactose crystals.

After the lactoserum has been seeded, it is concentrated in compartments 1 to 5, the concentrated lactoserum is finally brought to a supersaturated state and it is maintained at this state by evaporation produced in the compartments of the vat by heating means 20 to obtain a mixture of mother liquor and lactose crystals removed from the vat through outlet conduit 15. The heating of compartments 1 to 5 causes a portion of the water to be evaporated from the lactoserum in the compartments, eventually causing supersaturation thereof, and the water vapor evolving in the upper part of the vat is fed through conduit 21 to compressor 22. The concentration of the lactoserum in the successive compartments if maintained at a desired value controlled by the flow of lactoserum into the compartments and/or the flow of steam into heating means 20 so as to assure a regular growth of the crystals introduced into compartment 1 during their entire dwell time in apparatus 10. Pump 25 continuously removes the mixture of mother liquor and lactose crystals from the continuous crystallization stage. A level control controls the operation of pump 25 to maintain the level of the mixture in the vat substantially at mid-height. The dimensions of the vat are so selected as a function of the throughput that the dwell time has the desired value.

The evaporation in the first phase of crystallization is effectuated at a maximum temperature compatible with the thermal sensibility of the lactoserum and with a maximally attainable supersaturation of the concentrated product. This enhances the speed of crystallization and permits it to reach an order of six times that obtained in cooling crystallizers while producing a good yield of crystallized lactose. When whole lactoserum is used to feed the first phase of crystallization, the lactoserum is concentrated at a temperature of the order of 50° C. to 55° C. When the lactoserum is either deproteinized or demineralized lactoserum, the temperature is of the order of 65° C. to 70° C.

The dwell time in the vat is so selected that the lactose crystal content in the mother liquor removed from the first crystallization phase is as high as possible while being compatible with all operating conditions in the installation. For example, if deproteinized and demineralized lactoserum is crystallized, the dwell time in the continuous crystallization stage 10 is between one and three hours, the dry material (crystals) at the outlet of this stage is about 80% of the mixture and the crystal yield (weight ratio of crystallized lactose to total weight of lactose) is about 50 to 55%.

By using a fraction of the vapor generated in apparatus 10 to heat compartments 1 to 5 thereof after having been recompressed in compressor 22, the energy consumption is held to conventional limits while obtaining a high lactose crystal yield. The temperature of the heating vapor is of the order of 65° C. to 80° C.

The mixture removed through conduit 25 is subjected to a first centrifugal drying stage in continuously operating drier 12 which has screen 26 of a mesh size separating the mother liquor from the lactose crystals whose dimensions exceed the range of 40 to 90 microns while crystals of dimensions below this range remain in the mother liquor.

The use of centrifugal driers with continuously rotating frusto-conical baskets and screens produces crystals whose water content is much smaller than that of crystals separated in conventionally utilized centrifugal decanters and which are classified into separate portions of crystals of different dimensions, these dimensions being determined by the mesh size of the screen.

Preferably, as shown herein, the large-size crystals are washed in the centrifugal driers before being recovered therefrom. The wash water may be acidic, i.e. the water may contain hydrochloric acid and have a pH of about 2.5 to 3.5

The effectiveness of the centrifugal driers is greatly influenced by the granulometry of the crystals whose production they control. This permits the use of the above-described continuous crystallization stage to be used to feed the centrifugal driers in this process to obtain a lactose yield superior to that obtained by prior art lactose crystallization processes.

The major portion of mother liquor containing the small-sized crystals are pumped from chamber 30 into cooling vat 34 to cause the crystals in the mother liquor to grow therein. A minor portion thereof is fed by pump 42 to compartment 1 where the small-sized crystals serve as crystallization seeds. The output of pump 42 may be controlled as a function of the input of lactoserum through conduit 17 to the first phase of crystallization.

In cooling mixer 14, the mixture of mother liquor and small-sized crystals, which had a temperature of about 50° C. to 70° C. at the outlet of apparatus 10, is cooled to a temperature of about 10°–15° C. This cooling causes the crystals to grow and, therefore, permits a supplementary recovery of large-size crystals from a second centrifugal drying stage 16 where the grown crystals are separated from the mother liquor. Pump 44 serves not only to feed the product from cooling mixer 14 to centrifugal drier 16 but also recycles a fraction of the mother liquor removed from the bottom of vat 34 to the top thereof. This recycling prevents an excessively rapid decantation of crystals from the cooling mixer.

The mesh size of the screen of centrifugal drier 26 should be fine enough to permit the recovery of almost all the lactose crystals and may vary, for example, between 40 and 60 microns. These recovered crystals are directed towards the final stages of treatment, i.e. crushing-drying of refining. Alternatively, the crystals may be dissolved in water and the resultant solution may be introduced in apparatus 10 with the lactoserum.

To produce lactose of the highest purity, the lactose crystals obtained in the described manner are refined, and for this purpose, they are dissolved in water and the resultant solution, which may be purified, is subjected to the crystallization process again. An alternative process for obtaining a very high-purity lactose of pharmaceutical grade will be described hereinbelow in connection with FIG. 2.

In this embodiment of the process, the crystals from the first and second drying stages are mixed with water, the resultant mixture is subjected to another drying and washing in another continuous centrifugal drying stage, the mother liquor separated in the other drying stage is recycled upstream of the crystallization stage, and the wash water is used to prepare the mixture. The resultant crystals, which have a size between about 50 and 250 microns, are crushed to obtain a powder of a particle size between about 1 to 5 microns.

The modified installation illustrated in FIG. 2 only shows centrifugal driers 12 and 16 of the installation of FIG. 1, which produce the lactose crystals recovered from this installation. These crystals are fed to mixer 46 where they are mixed with water. The mixture of crystals and water is fed from mixer 46 to another centrifugal drier 48 (of the same general type as described hereinabove) for drying the mixture and and washing the crystals, the other centrifugal drier comprising washing means 50 and the same means as hereinabove described for separately collecting the mother liquor and the washing water of the crystals.

The washing water is fed from drier 48 to mixer 46 where it is admixed to the crystals fed thereto from driers 12 and 16. The mother liquor separated from the crystals in drier 48 is fed through conduit 52 to the upstream end of the first phase of crystallization.

While the process and installation of this invention have been described in connection with two specific embodiments, equivalent steps and means may obviously be used without departing from the spirit and scope of the invention as defined in the appended claims.

What is claimed is:

1. A process of producing crystallized lactose from lactoserum which comprises the steps of:

(a) continuously feeding small-size crystals of lactose to an inlet end of a crystallization apparatus comprising a succession of compartments extending from the inlet end to an outlet end of the crystallization apparatus, said small-size crystals constituting seeds of crystallization, (b) continuously feeding lactoserum to one of the compartments of the crystallization apparatus while continuously feeding the small-size lactose crystals, (c) continuously displacing the lactoserum and lactose crystals through the successive compartments to the outlet end of the crystallization apparatus, (d) heating the lactoserum in the compartments so as to maintain its temperature at a maximum value compatible with the thermal sensibility of the lactoserum and cause a portion of water from the lactoserum to be evaporated, (e) controlling the flow of lactoserum fed to the compartments so as to maintain the concentration of the lactoserum at a desired value and assure a regular growth of the lactose crystals, whereby a mixture of a mother liquor and lactose crystals is obtained, (f) continuously removing said mixture from the outlet end of said crystallization apparatus and feeding the removed mixture to a first continuously operating centrifugal drier having a screen, (g) continuously separating in said first drier the lactose crystals whose dimensions exceed the range of 40 to 90 microns from the mother liquor, the crystals having dimensions below said range being left in the mother liquor, (h) continuously cooling the mother liquor discharged from said first drier to cause the crystals left in the mother liquor to grow, (i) continuously feeding the mother liquor with the grown crystals to a second continuously operating centrifugal drier, and continuously separating the grown crystals from the mother liquor.

2. The process of claim 1, wherein a portion of the mother liquor discharged from the first drier is fed to the inlet end of the crystallization apparatus, the crystals contained in said portion of the mother liquor constituting the said small-size crystals.

3. The process of claim 1, wherein the lactoserum is whole lactoserum, further comprising the step of heating the lactoserum in the crystallization apparatus to a temperature of 50° C. to 55° C.

4. The process of claim 1, wherein the lactoserum is selected from the group consisting of deproteinized lactoserum and demineralized lactoserum, further comprising the step of heating the lactoserum in the crystallization apparatus to a temperature of 65° C. to 70° C.

5. The process of claim 1, wherein the dwell time in the crystallization apparatus is between one and three hours.

6. The process of claim 1, wherein the concentration of dry material in the lactoserum fed to the crystallization apparatus is about 50% to 55% and the concentration of dry material in the mixture removed from the crystallization apparatus is about 80%.

7. The process of claim 1, wherein the lactoserum is heated in the crystallization apparatus by heating means constituted by hollow elements fed with vapor having a temperature between 65° C. and 80° C.

8. The process of claim 7, wherein a portion of the vapor fed to said hollow elements is constituted by vapor generated by the evaporation of water from the lactoserum in the crystallization apparatus, said vapor being compressed before being fed to the hollow elements.

9. The process of claim 1, comprising the further step of subjecting the crystals separated from the mother liquor in the first drier to washing with water.

10. The process of claim 9, wherein the wash water is acidic.

* * * * *